United States Patent [19]

Davidson

[11] 4,180,928

[45] Jan. 1, 1980

[54] SELF-CLEAN STEAM IRON

[75] Inventor: William E. Davidson, Ontario, Calif.

[73] Assignee: General Electric Company, New York, N.Y.

[21] Appl. No.: 925,060

[22] Filed: Jul. 17, 1978

[51] Int. Cl.[2] ..... D06F 75/06

[52] U.S. Cl. ..... 38/77.83

[58] Field of Search ..... 38/77.83, 77.5, 77.7, 38/77.8, 77.9

[56] References Cited

U.S. PATENT DOCUMENTS

| | | | |
|---|---|---|---|
| 3,599,357 | 8/1971 | Gronwick | 38/77.5 |
| 3,711,972 | 1/1973 | Risacher | 38/77.83 |
| 3,747,241 | 7/1973 | Davidson | 38/77.83 |
| 3,823,498 | 7/1974 | Davidson | 38/77.83 |
| 3,872,613 | 3/1975 | Davidson et al. | 38/77.83 |
| 3,872,613 | 3/1975 | Davidson et al. | 38/77.83 |
| 4,077,143 | 3/1978 | Walker et al. | 38/77.83 |

*Primary Examiner*—Louis Rimrodt

*Attorney, Agent, or Firm*—John F. Cullen; George R. Powers; Leonard J. Platt

[57] ABSTRACT

In a steam iron with the water tank above an electrically heated soleplate with steam apertures, a primary steam generator is disposed in the soleplate and fed from the tank by a metering water valve for steam generation. A cover plate over the soleplate forms distributing passages connecting the primary generator with the apertures and a separate surge generator is provided and fed by a surge valve for intermittent steam generation. A duct connects the surge generator in upstream flow series relation so surge steam flows through the duct into the primary generator and then through the distributing passages to the apertures for a surge of steam. To this general arrangement, an improvement is provided comprising a converging nozzle means forming the exit from the duct and discharging centrally of the primary generator whereby the nozzle increases the surge steam velocity into the primary generator to scrub the generator before entering the distribution passages to the soleplate apertures.

6 Claims, 2 Drawing Figures

SELF-CLEAN STEAM IRON

BACKGROUND OF THE INVENTION

1. Field of the Invention

The invention herein pertains to an electric steam iron with separate generating means that may be pump-fed to provide extra surge steam capacity through the normal soleplate ports when extra steam is required while also providing a self-clean arrangement whereby the surge of steam effectively cleans the main steam boiler on each use.

2. Description of the Prior Art

Many, if not most, of the present irons use water for either steam or spray or both and a water tank is provided in the iron above the soleplate with water valve structure providing metered drippage of water into a primary steam generator where it is flashed into steam and directed out apertures or ports in the soleplate to steam the article. It has become common to provide extra steam capacity in which a surge of steam is delivered by providing means whereby an extra slug of water is pumped into the steam generating area, usually into a separate generator and with the entire steam-generating system being within the confines of the heating element, whereby the surge of steam and the main steam are both fed directly into a main distributing passage system after passage through a tortuous path. The extra steam may be passed first, through the main generator and then, into the distribution passages to exit the soleplate ports as extra capacity or surge steam. Such systems are shown in U.S. Pat. Nos. 3,599,357 and 3,711,972 respectively. Another form, or hybrid system, for an extra surge of steam is shown in U.S. Pat. No. 4,077,143 of common assignment. Additionally, self-cleaning irons of various forms have been disclosed such as where an extra large surge of steam is created to purge or flush out the internal passages and ports to remove deposits within the iron, this basic concept being shown in U.S. Pat. No. 3,747,241 of common assignment. This concept, with other internal cleaning means, such as valve structure cleaning, provides a very adequate self-cleaning iron. Some irons with the extra surge capacity provide cleaning of the soleplate ports by the larger volume of exiting steam through the ports but do not completely clean the internals of the iron. A typical extra surge capacity steam iron is disclosed in said U.S. Pat. No. 3,711,972 on which the instant invention improves.

SUMMARY OF THE INVENTION

Briefly described the invention is directed to a steam iron with a water tank above an electrically heated soleplate with steam apertures with a primary steam generator disposed in the soleplate and fed from the tank by a water valve for steam generation. A cover-plate over the soleplate forms distributing passages connecting the primary generator with the apertures and a separate surge generator is provided and fed by a surge valve for intermittent steam generation. A duct connects the surge generator in upstream flow series relation so surge steam flows through the duct into the primary generator and then through the distributing passages to the apertures for a surge of steam. To this general arrangement of U.S. Pat. No. 3,711,972 an improvement is provided comprising a converging nozzle means forming the exit from the duct and discharging centrally of the primary generator whereby the nozzle increases the surge steam velocity into the primary generator to scrub the generator before entering the distribution passages to the soleplate apertures. Thus, the main object of the invention is to disclose a steam iron of the general type of U.S. Pat. No. 3,711,972 with improved means to provide internal self-cleaning capacity including self-cleaning of the primary steam generator while maintaining all the functions of the extra surge of steam on demand.

DESCRIPTION OF PREFERRED EMBODIMENT

The invention will be described as a steam iron of a general type and specifically as an improvement on U.S. Pat. No. 3,711,972. It should be understood that various attachments, such as sprays, may be applied and the invention is also applicable to unpressurized or pressurized irons.

Figure 1:
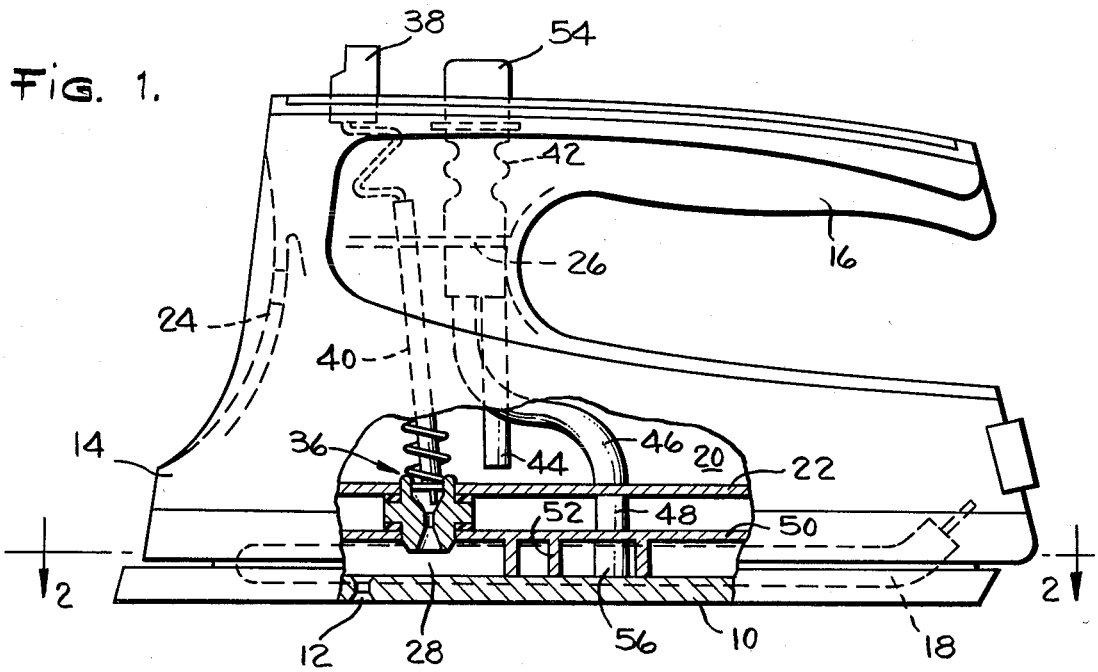
FIG. 1 is an elevational view, partly in section on line 1—1 of FIG. 2 and partly in phantom, showing a steam iron for horizontal surging.
Figure 2:
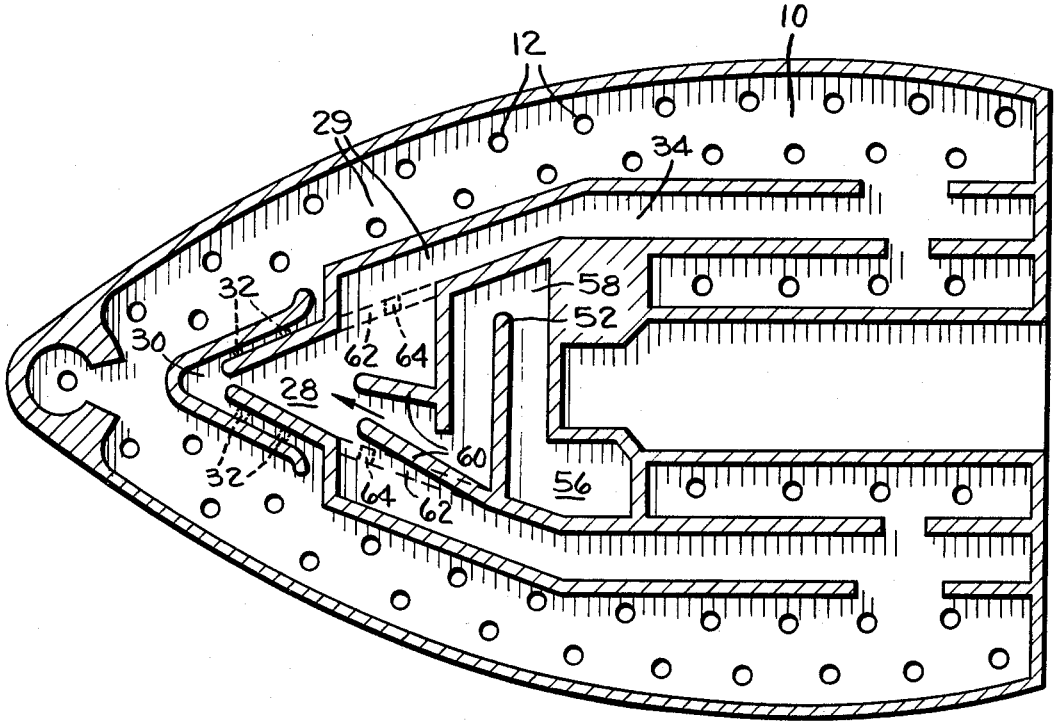
FIG. 2 is an enlarged sectional view taken on line 2—2 of FIG. 1 showing structure for self-cleaning and for surging with a modification shown dotted.

The invention discloses a steam iron which may be operated dry, steaming, and having an extra surge of steam when desired, all as disclosed in said U.S. Pat. No. 3,711,972. Referring to FIG. 1, there is shown a steam iron including soleplate 10 having a plurality of steam ports or apertures 12 oriented in any suitable manner to direct steam through the soleplate and having an outer metal or plastic shell 14 suitably connected to or integrally formed with closed or open handle 16 as shown. In accordance with conventional practice, soleplate 10 is made from material such as cast aluminum with an electrical loop-shaped element 18 cast in position or, alternately, the soleplate 10 may be a thin soleplate with heating element 18 welded thereto as in U.S. Pat. No. 3,939,325 of common assignment disclosing a wrought soleplate construction. The heating element 18 is controlled from a cord through thermostatic means in a well-known manner. The iron, as described, may use complementary and vertically facing symmetrical sealed halves, and includes means for generating steam by providing water tank 20 directly above the electrically heated soleplate 10. The tank may be integrally formed of plastic as shown in FIG. 1 with a spaced bottom 22 separating the tank from the heating element 18. A suitable fill opening 24 in shell 14 and an integrally molded internal handle wall 26 complete the tank. For standard steam, a conventional primary steam generator 28 is provided in the soleplate in the usual manner with the generator feeding suitable distributing passages 29 that connect with the primary generator to exit through apertures 12. The steam may follow suitable paths defined by various walls in the soleplate causing it to travel longer distances over the heating element 18 for complete steam conversion. Thus, as shown in FIG. 2, the main steam generator 28 will feed some of the steam through a tortuous reverse passage 30 where dams 32 interrupt and direct the steam towards the hot soleplate for better heat transfer with the steam migrating along passage 30 towards the rear of the iron in a generally conventional and known fashion, primarily for better heat transfer with the embedded heater 18. Steam is formed by metering water through a water valve 36 activated by a steam control button 38 and connected spring biased vertical stem 40 all in a conventional manner.

For surging, the iron has a bellows-type pump 42 with an inlet tube 44 in the water tank 20 and an outlet tube 46 directing the water to a surge valve or outlet 48 disposed in an opening in coverplate 50 which may be flat or contain various ribs 52 to define passages with soleplate 10 in any suitable distributing pattern as in U.S. Pat. No. 3,711,972, where manual depression of surge button 54 actuates the pump and subsequent release permits the pump to refill. A separate surge generator 56 is disposed between coverplate 50 and soleplate 10 and is fed by surge valve 48 for intermittent steam generation by actuation of surge button 54. The surge generator 56 is disposed rearwardly of the primary generator 28 and in upstream series flow relation through an 'S' shaped duct 58 formed by ribs 52 extending from coverplate 50. Thus, water can enter each generator independently and the arrangement is such with the primary generator 28 being downstream from and common to the path the steam created in surge generator 56 must take for exit to soleplate apertures 12, the path is generally from the upstream surge generator 56 through the tortuous 'S' duct 58 in a generally horizontal plane over a long flow series path of relatively large area good heat transfer for conversion of the surge water into steam before entering the distribution passages and exit from the soleplate apertures. This general arrangement is shown in said U.S. Pat. No. 3,711,972.

In accordance with the invention, an improved self-cleaning feature is provided to this known structure by providing a nozzle means between the surge generator and main generator to direct the surge steam at high velocity into the main generator and, thus, scrub it of deposits before continuing on its conventional path. To this end, the exit from duct 58 is modified to provide converging walls 60 of a suitable length and convergency to create a nozzle for increasing the steam velocity, the nozzle, as shown, preferably being formed in the coverplate and being oriented to discharge directly into primary generator 28 in any position, with a preferable form being centrally of the primary generator as shown. Thus, a nozzle is provided at the outlet of tortuous duct 58 from surge generator 56. While the arrangement shown may permit some of the steam to migrate into passages 34, a modification may employ dotted wall means 62 with ports 64 which, because of the steam velocity exiting the nozzle, funnels substantially all of the nozzle steam into primary chamber 28 because the nozzle is bounded by and disposed within the walls as shown. Normal steam operation formed directly in primary chamber 28 still continues through passages 30 and into passages 34.

Thus, the present invention is directed to an improvement on said U.S. Pat. No. 3,711,972 by the provision of nozzle 60 so that all surge steam not only provides surge capacity to the iron but also is directed at increased velocity in a series flow relation in a substantially horizontal plane directly into primary generator 28 to scrub it clean of mineral deposits on each operation of the surge feature providing better and more efficient internal cleaning of the iron.

While I have hereinbefore described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a steam iron with a water tank above an electrically heated soleplate with apertures therein, a primary steam generator in said soleplate fed from said tank by a water valve for steam generation, a coverplate over said soleplate forming distributing passages connecting said primary generator with said apertures, a separate surge generator fed by a surge valve for intermittent steam generation, a duct connecting said surge generator in upstream flow series relation so surge steam flows through said duct into said primary generator and thence through said distributing passages to said apertures for a surge of steam, the improvement comprising, converging nozzle means in said duct, said nozzle increasing the surge steam velocity into said primary generator to scrub said generator before entering the distribution passages to said apertures.

2. Apparatus as described in claim 1 wherein said surge generator is disposed upstream of said primary generator to discharge in a horizontal plane into said primary generator.

3. Apparatus as described in claim 2 wherein said nozzle forms the exit from said duct to discharge directly into said primary generator.

4. Apparatus as described in claim 3 wherein said nozzle is formed in the coverplate and is oriented to discharge substantially centrally of said primary generator.

5. Apparatus as described in claim 2 wherein said duct is a tortuous path from said surge generator to said nozzle outlet.

6. Apparatus as described in claim 5 wherein wall means connects said tortuous path duct to funnel all said steam into the primary chamber, and said nozzle is disposed within said walls.

* * * * *